United States Patent [19]

Keller

[11] Patent Number: 4,779,337

[45] Date of Patent: Oct. 25, 1988

[54] DEVICE FOR THE STENCIL-FERRULE MOUNTING OF SCREEN PRINTING CYLINDERS

[75] Inventor: Heinz Keller, St. Gall, Switzerland

[73] Assignee: Ferd. Ruesch AG, St. Gall, Switzerland

[21] Appl. No.: 870,704

[22] Filed: Jun. 4, 1986

[30] Foreign Application Priority Data

Jul. 19, 1985 [DE] Fed. Rep. of Germany ..... 3525795

[51] Int. Cl.[4] ..... B21H 1/14; B41F 13/10

[52] U.S. Cl. ..... 29/800; 29/447; 101/116

[58] Field of Search ..... 101/114, 116, 115, 212; 29/110, 123, 447, 800; 269/48.1

[56] References Cited

U.S. PATENT DOCUMENTS

| | | | |
|---|---|---|---|
| 4,026,208 | 5/1977 | Horne et al. | 101/116 |
| 4,069,567 | 1/1978 | Schwartz | 29/447 |
| 4,305,203 | 12/1981 | Bock et al. | 29/800 |
| 4,317,270 | 3/1982 | Watanabe et al. | 29/447 |
| 4,461,663 | 7/1984 | Tachibani et al. | 29/447 |
| 4,500,235 | 2/1985 | Johnsen | 269/48.1 |

FOREIGN PATENT DOCUMENTS

| | | | |
|---|---|---|---|
| 2332129 | 1/1975 | Fed. Rep. of Germany . | |
| 0870048 | 10/1981 | U.S.S.R. | 29/800 |

*Primary Examiner*—Timothy V. Eley
*Attorney, Agent, or Firm*—Kenyon & Kenyon

[57] ABSTRACT

An apparatus for inserting stencil ferrules into the ends of a screen printing cylinder comprising chamber means, having a floor and a ceiling; base means secured within the chamber means and adaptable to releasably support a first stencil ferrule which engages one end of the screen printing cylinder; pivoting guide means positioned concentrically above the base means by a longitudinally adjustable support means, the guide means being adaptable to releasably support a second stencil ferrule which engages the other end of the screen printing cylinder, the support means being secured within the chamber means; means for supplying a heated fluid to the chamber means; and means for evacuating the heated fluid from the chamber means.

5 Claims, 1 Drawing Sheet

DEVICE FOR THE STENCIL-FERRULE MOUNTING OF SCREEN PRINTING CYLINDERS

Figure 1:
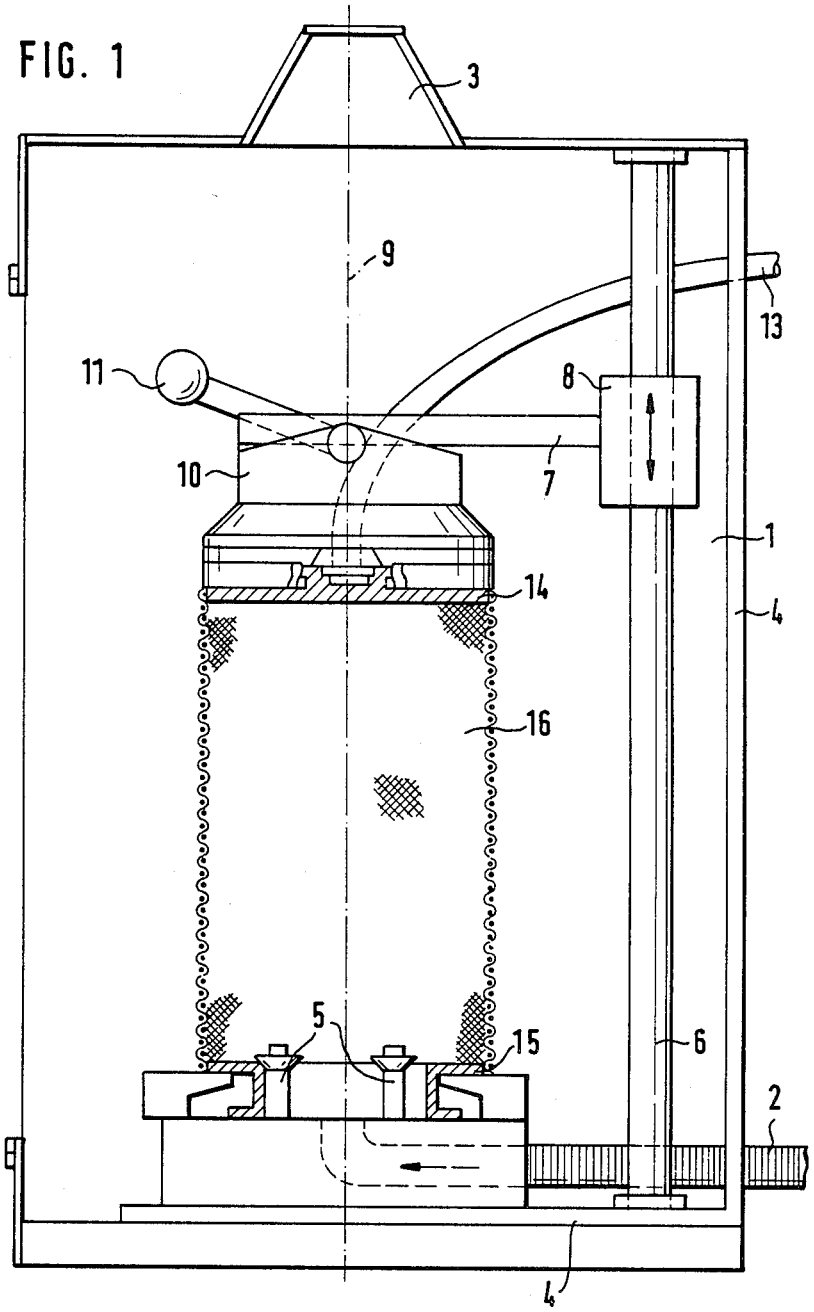

The object of the invention is a device by means of which stencil-ferrules can be inserted parallelly at a predetermined spacing and axially aligned into a cylinder jacket consisting of a nickel-plated chromium-steel fabric.

Upon the use for rotary screen printing of cylindrical screen printing stencils which consist of a fabric reinforced by metallization, the correct mounting of the stencil-ferrules into the cylinder jacket is of particular significance for the usability of a screen printing cylinder in rapidly running rotary printing machines since the position of the stencil-ferrules guarantees not only the length of the cylinder, but, owing to their axial alignment and parallelism, also the correct mounting of the cylinder and, thereby, the accurate concentricity of the cylinder which, owing to the metallization of a steel-wire fabric, has only a limited inherent rigidity. It has therefore been attempted to obviate the drawbacks of the manual mounting of stencil-ferrules and of the limited inherent rigidity, and the related rejection of the cylinder jacket upon printing with a stationary screen inside the cylinder, in that the cylinders are being borne in ball-and-socket joints that absorb the inherent movements of the cylinder jacket in the bearing. It is true that these measures make it possible to print rotatively large surfaces, e.g., wall paper, by screen printing. An accuracy of fit can thereby however not be achieved. Apart from that, such bearings are costly and uneconomical.

From the DE-09 2,332,129 there is known a device for the mounting of stencil-ferrules in hose-like screen-printing stencils, by means of which the stencil-ferrules are inserted into an axial clamping device, then the extremities of the hose-like screen-printing stencil are secured on the stencil-ferrules with hose clamps, and the resultant screen printing cylinder is pretensioned by means of the axial tensioning device. For the mounting of the screen printing cylinders, the same is installed with the axial clamping device into the screen printing mechanism, and the axial clamping device is removed from the screen printing cylinder borne in the printing mechanism. This device is attended by the drawback that the screen printing cylinder has to be pretensioned with the axial clamping device prior to every disassembly and every re-use for its removal from the printing mechanism as well as for its re-use. This is, on the one hand, costly, on the other hand, absolute repeatability is not made possible with regard to accuracy of fit.

It is the object of the invention to obviate the known drawbacks by a mounting of the terminal disks or stencil rings that is absolutely accurate with regard to spacing, parallelism, and axial alignment, and thereby to guarantee a bearing that permits a distortion-free rotation of the only restrictively rigid screen printing cylinder.

The solution of the object is viewed in a device by means of which the stencil-ferrules of screen printing cylinders of metallized steel-wire fabric are inserted semi-automatically with absolute repeatability into the cylinder jacket, aligned, and inserted into the cylinder jacket with a thermo-settable cement in such a way that, following cooling and the accompanying shrinking of the screen-printing cylinder, the stencil-ferrules accurately define the terminal disks of the cylinder with regard to their parallel spacing, their parallelism, and their axial alignment.

The device according to the invention consists of a heatable drying cabinet with lockable doors, in the floor of which there is arranged a three-jaw chuck for accommodating and aligning of the lower stencil-ferrule and at the rear wall of which there are arranged at absolutely right angles to the plane of the three-jaw chuck two guide rods arranged outside the cylinder for accommodating an assembly carriage vertically displaceable at the guide rods, for the upper stencil-ferrule.

The assembly carriage consists of an oriented absolutely parallel and axially aligned to the plane of the three-jaw chuck with a vacuum holding means, pivotable toward the axis of the screen printing cylinder, for the upper stencil-ferrule.

There are furthermore provided means for automatic heating, ventilating, and releasing of the vacuum holding means following completion of the drying cycle of the stencil-ferrule cementing.

For the inserting, aligning, and cementing of a screen printing cylinder jacket, one clamps first the lower cement-coated stencil-ferrule onto the three-jaw chuck and the upper cement-coated stencil-ferrule is inserted into the vacuum holding means of the assembly carriage serving merely for the stencil guidance. Then, the cylinder jacket is placed onto the lower stencil-ferrule, and the assembly carriage standing with the vacuum holding means pivoted slightly away from the cylinder axis is lowered onto the cylinder jacket in such a way that the stencil-ferrule will insert itself with its circumference conically into the cylinder jacket, accompanied by simultaneous pivoting into the cylinder axis. The stencil-ferrule is thereby lowered into the cylinder jacket only by a distance that corresponds to the balance of the elevation of the cylinder jacket prior to heating. Subsequently, the cabinet is closed and heated at a predetermined temperature and time. During the heating, the cylinder jacket grows, as a result of the precalculated heat expansion, to such a height above the jacket of the stencil-ferrule until the cylinder jacket terminates with the upper edge of the stencil-ferrule. Following expiration of the precalculated curing time, the cabinet is ventilated and cooled down to room temperature. In so doing, the cylinder jacket shrinks not only onto the stencil-ferrules, but the cylinder length is also reduced again to its original length. Thus, simultaneously with the arresting of the heating, the vacuum holding means of the upper stencil-ferrule is released so that the originating of tensions or tearings in the cylinder jacket is avoided, and the now finished screen printing cylinder can adjust to the precalculated cylinder length at room temperature.

For a further explanation of the invention reference is had to the exemplified embodiment illustrated in the enclosed drawing in which:

FIG. 1 shows a schematic representation of the device in an open side view.

The device consists of a cabinet 1 provided in the front with lockable doors, which is provided with a hot-air supply 2 and a closable exhaust air vent 3.

In the hot-air supply 2 there is arranged a thermostat (not shown) by means of which the temperature of the hot air which, in view of the light-sensitive coating of the cylinder jacket, may not exceed 60° C., is controlled at the hot air source. In the floor and in the rear wall of the cabinet 1 there is arranged an absolutely square holding means 4, made of heavy steel plate in welded design, for the accommodating of the three-jaw chuck 5 and the guide rods 6 for the guidance of the assembly carriage 7. The assembly carriage 7 consists of a rod mounting-support 8 displaceable and securable on the guide rods 6, a holding means 10 (inside of which there is arranged a vacuum suction 13) readily pivotable with respect to the longitudinal cylinder axis 9 by means of a lever 11, whose axis is aligned with the axis of the lower three-jaw chuck 5.

The cylinder jacket 16 with the terminal disks 14, 15 is being held by the three-jaw chuck 5.

The device permits the assembly of terminal disks in cylinder jackets of different lengths and different diameters.

I claim:

1. An apparatus for inserting stencil ferrules into the ends of a screen printing cylinder comprising:

(a) chamber means having a floor and a ceiling;

(b) base means secured within said chamber means and adaptable to releasably support a first stencil ferrule which engages one end of the screen printing cylinder;

(c) pivoting guide means positioned concentrically above said base means by a longitudinally adjustable support means, said guide means being adaptable to releasably support a second stencil ferrule which engages the other end of the screen printing cylinder, said support means being secured within said chamber means;

(d) means for supplying a heated fluid to said chamber means; and (e) means for evacuating said heated fluid from said chamber means;

2. The apparatus of claim 1, wherein said base means comprises a plurality of cylindrical chucks and said guide means pivot thereby concentrically positioning said second stencil ferrule partially within said cylinder.

3. The apparatus of claim 2, wherein the longitudinally adjustable support means comprises a rod mounted between the floor and ceiling of said chamber means and pivotally connected to said guide means by means of a cross bar connected to a sleeve mounted concentrically on said rod.

4. The apparatus of claim 3 wherein said means for supplying a heated fluid comprises pipe means which supply pressurized hot air.

5. The apparatus of claim 4 wherein said means for evacuating pressurized heated fluid from said chamber comprises an adjustable exhaust air vent.

* * * * *